US008410877B1

(12) United States Patent
Takaya et al.

(10) Patent No.: US 8,410,877 B1
(45) Date of Patent: Apr. 2, 2013

(54) ELECTROMAGNETIC CONTACTOR AND ASSEMBLY METHOD FOR THE SAME

(75) Inventors: Kouetsu Takaya, Kounosu (JP); Koji Okubo, Kounosu (JP); Yasuhiro Naka, Kounosu (JP); Kenji Suzuki, Kounosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/519,759

(22) PCT Filed: Dec. 20, 2010

(86) PCT No.: PCT/JP2010/007384

§ 371 (c)(1),
(2), (4) Date: Aug. 7, 2012

(87) PCT Pub. No.: WO2011/148448

PCT Pub. Date: Dec. 1, 2011

(30) Foreign Application Priority Data

May 27, 2010 (JP) ..... 2010-121653

(51) Int. Cl.
*H01H 7/16* (2006.01)
*H01H 67/02* (2006.01)
*H01H 3/00* (2006.01)
*H01H 13/04* (2006.01)

(52) U.S. Cl. ..... 335/156; 335/129; 335/131; 335/189; 335/202

(58) Field of Classification Search ..... 335/129, 335/131, 156, 185, 189, 202
See application file for complete search history.

(56) References Cited

FOREIGN PATENT DOCUMENTS

| | | | |
|---|---|---|---|
| JP | S64-48339 | A | 2/1989 |
| JP | H02-59550 | U | 5/1990 |
| JP | H03-110733 | A | 5/1991 |
| JP | H06-86245 | U | 12/1994 |
| JP | H07-44866 | U | 11/1995 |
| JP | 2001-222940 | A | 8/2001 |
| JP | 2006-012842 | A | 1/2006 |

*Primary Examiner* — Ramon Barrera
(74) *Attorney, Agent, or Firm* — Manabu Kanesaka

(57) ABSTRACT

There is provided a drive lever incorrect assembly detection portion (9*d*) and (14) which causes another end portion (9*a*) of a drive lever (9) to protrude to a position, of a case (4), to which a cover (5) is attached such that the cover (5) cannot be attached to the case (4) in a state where the drive lever (9) is assembled in an incorrect direction.

3 Claims, 7 Drawing Sheets

CORRECT ASSEMBLY STATE

INCORRECT ASSEMBLY STATE

ELECTROMAGNETIC CONTACTOR AND ASSEMBLY METHOD FOR THE SAME

RELATED APPLICATIONS

The present application is National Phase of International Application No. PCT/JP2010/007384 filed Dec. 20, 2010, and claims priority from Japanese Application No. 2010-121653, filed May 27, 2010.

TECHNICAL FIELD

The present invention relates to an electromagnetic contactor having a drive lever which transmits an attraction movement and a release movement of a movable core of an electromagnet to a movable contact support, and an assembly method for the same.

BACKGROUND ART

As an electromagnetic contactor, there is known a device of, e.g., Patent Document 1.

In the electromagnetic contactor of Patent Document 1, there are accommodated in a case, an electromagnet, a movable contact support disposed in parallel with the electromagnet, a return spring urging the movable contact support toward an initial position, and a drive lever which transmits an attraction movement and a release movement of the electromagnet to the movable contact support.

The movable contact support includes a plurality of movable contacts, moves against the return spring, and performs an opening and closing operation with fixed contacts disposed in the case so as to face the individual movable contacts. The electromagnet includes an exciting coil, a fixed core, and a movable core which is disposed to face the fixed core so as to be movable close to or away from the fixed core.

The drive lever is an elongated plate-like member, and is formed with arm portions in the central portion in a longitudinal direction, and a protrusion on one side surface of one end portion in a plate thickness direction.

One end portion of the drive lever is inserted into an insertion hole of the movable contact support, the arm portions thereof abut on a receiving surface formed on an opening peripheral edge of the insertion hole, and the drive lever is thereby engaged with the movable contact support. Further, the drive lever is assembled in a state where one end portion is inserted into a loose-fitting hole formed in the movable core, the protrusion formed at one end portion is contacting with an inner surface of the loose-fitting hole which is farthest from the fixed core, and the other end portion is engaged with a receiving groove formed in an inner wall of an upper case which faces the movable core via the movable contact support.

When the exciting coil of the electromagnet is brought into an excited state and the movable core of the electromagnet is attracted by the fixed core, the movement of the movable core by the attraction is transmitted to the drive lever via the protrusion at one end portion, and the drive lever rotates about the other end portion engaged with the receiving groove of the upper case, whereby the rotation of the drive lever is transmitted to the movable contact support as a predetermined stroke, the movable contact support moves from the initial position to an operation position, and the opening and closing operation of the individual movable contacts and the corresponding fixed contacts is performed.

Patent Document 1: Japanese Patent publication No. S64-48339 (FIGS. 1 and 2)

The drive lever of Patent Document 1 has directivity at the time of assembly that the drive lever is assembled in the state where the protrusion formed at one end portion is in contact with the inner surface of the loose-fitting hole formed in the movable core which is farthest from the fixed core.

However, even when the assembly of the drive lever of Patent Document 1 is performed in a state where the drive lever is oriented in the opposite direction in which the protrusion at one end portion does not abut on the inner surface of the loose-fitting hole (hereinafter referred to as incorrect assembly), the drive lever can be attached into an electromagnetic contactor, and therefore the incorrect assembly of the drive lever may impair the normal operation of the electromagnetic contactor.

That is, in the drive lever of Patent Document 1, there are formed a pair of arm portions which protrude outward in mutually opposite directions from end portions in a plate width direction at the same positions (the central portion) in the longitudinal direction and, even when the incorrect assembly of the drive lever is performed with the pair of arm portions disposed in a direction opposite to that in the correct assembly and caused to abut on the receiving surface of the insertion hole, the drive lever can be attached into the electromagnetic contactor.

In the drive lever assembled by the incorrect assembly, since the protrusion at one end portion does not contact with the inner surface of the loose-fitting hole formed in the movable core which is farthest from the fixed core, the movement operation of the movable core of the electromagnet may not be transmitted to the movable contact support as the predetermined stroke, and the opening and closing operation of the movable contacts and the fixed contacts may not be performed normally in the electromagnetic contactor having the drive lever assembled by the incorrect assembly.

DISCLOSURE OF THE INVENTION

Consequently, in the electromagnetic contactor having the drive lever of Patent Document 1, it is necessary to visually ascertain the assembly direction of the drive lever at the time of the assembly, and there arises a problem that a time required for the assembly is increased and assembly efficiency is thereby reduced.

In view of the foregoing, the present invention has been achieved by focusing on the unsolved problem of the conventional art described above, and an object thereof is to provide an electromagnetic contactor and an assembly method for the same, capable of reliably preventing incorrect assembly of a drive lever having directivity at the time of assembly.

In order to achieve the foregoing object, an electromagnetic contactor according to an embodiment of the present invention is an electromagnetic contactor comprising a case accommodating an electromagnet having a movable core; a movable contact support moving in parallel with a moving direction of the movable core; and a drive lever which has directivity in assembly in the case, one end portion engaged with the movable core, and a central portion in a longitudinal direction engaged with the movable contact support. The movement of the movable core is transmitted to the movable contact support by the drive lever made rotatable about another end portion of the drive lever serving as a rotation shaft by engaging the other end portion of the drive lever to an inner wall of a cover attached to the case covering the movable contact support. A drive lever incorrect assembly detection portion is provided in which in a state where the drive lever is assembled in a correct direction, the drive lever is accommodated to attach the cover to the case, and in a state where the drive lever is assembled in an incorrect direction, the other end portion of the drive lever protrudes to a position where the cover is to be attached to the case to prevent the attachment of the cover to the case.

According to the electromagnetic contactor according to the embodiment of the present invention, when the drive lever having directivity at the time of assembly is oriented in the incorrect direction and assembled in the case, since the attachment of the cover to the case is prevented by the drive lever incorrect assembly detection portion, it is possible to easily recognize the incorrect assembly of the drive lever.

In addition, in the electromagnetic contactor according to the embodiment of the present invention, the drive lever incorrect assembly detection portion comprises an arm portion formed in the central portion of the drive lever and protruding from one end portion in a direction orthogonal to a rotation direction of the drive lever, an arm portion receiving surface formed on the movable contact support, and on which the arm portion abuts while accommodating the drive lever to attach the cover to the case in the state in which the drive lever is assembled in the correct direction, and an incorrect assembly preventing surface formed on the movable contact support to be closer to a position where the cover is attached than the arm portion receiving surface, and on which the arm portion abuts to protrude the other end portion of the drive lever to the position where the cover is to be attached to the case in the state in which the drive lever is assembled in the incorrect direction.

According to the electromagnetic contactor according to the embodiment of the present invention, since the drive lever incorrect assembly detection portion is formed of the simple structure including the arm portion formed in the drive lever, and the arm portion receiving surface and the incorrect assembly preventing surface which are formed on the movable contact support into a stepped shape, a reduction in manufacturing cost is achieved.

Further, an assembly method for an electromagnetic contactor according to an embodiment of the present invention, comprising the steps of after accommodating the electromagnet, the movable contact support, and the drive lever in the case, judging whether attaching the cover to the case is possible, or whether the attaching the cover to the case is not possible by protruding the other end portion of the drive lever to the position where the cover is to be attached to the case, and determining the presence of the incorrect assembly of the drive lever.

According to the assembly method for an electromagnetic contactor according to the embodiment of the present invention, since it is possible to lessen work for visually ascertaining the orientation of the assembly of the drive lever when the drive lever is assembled, and reduce a time required for the assembly of the electromagnetic contactor, assembly efficiency is improved.

According to an electromagnetic contactor according to the present invention, when a drive lever having directivity at the time of assembly is oriented in an incorrect direction and assembled in a case, since the attachment of a cover to the case is prevented by a drive lever incorrect assembly detection portion, it is possible to easily recognize the incorrect assembly of the drive lever.

In addition, according to an assembly method for an electromagnetic contactor according to the present invention, since it is possible to lessen work for visually ascertaining an orientation of assembly of a drive lever when the drive lever is assembled, and reduce a time required for the assembly of the electromagnetic contactor, it is possible to improve assembly efficiency.

BEST MODE FOR CARRYING OUT THE INVENTION

A detailed description is given hereinbelow of the best mode for carrying out the present invention (hereinafter referred to as an embodiment) with reference to the drawings.

Figure 1:
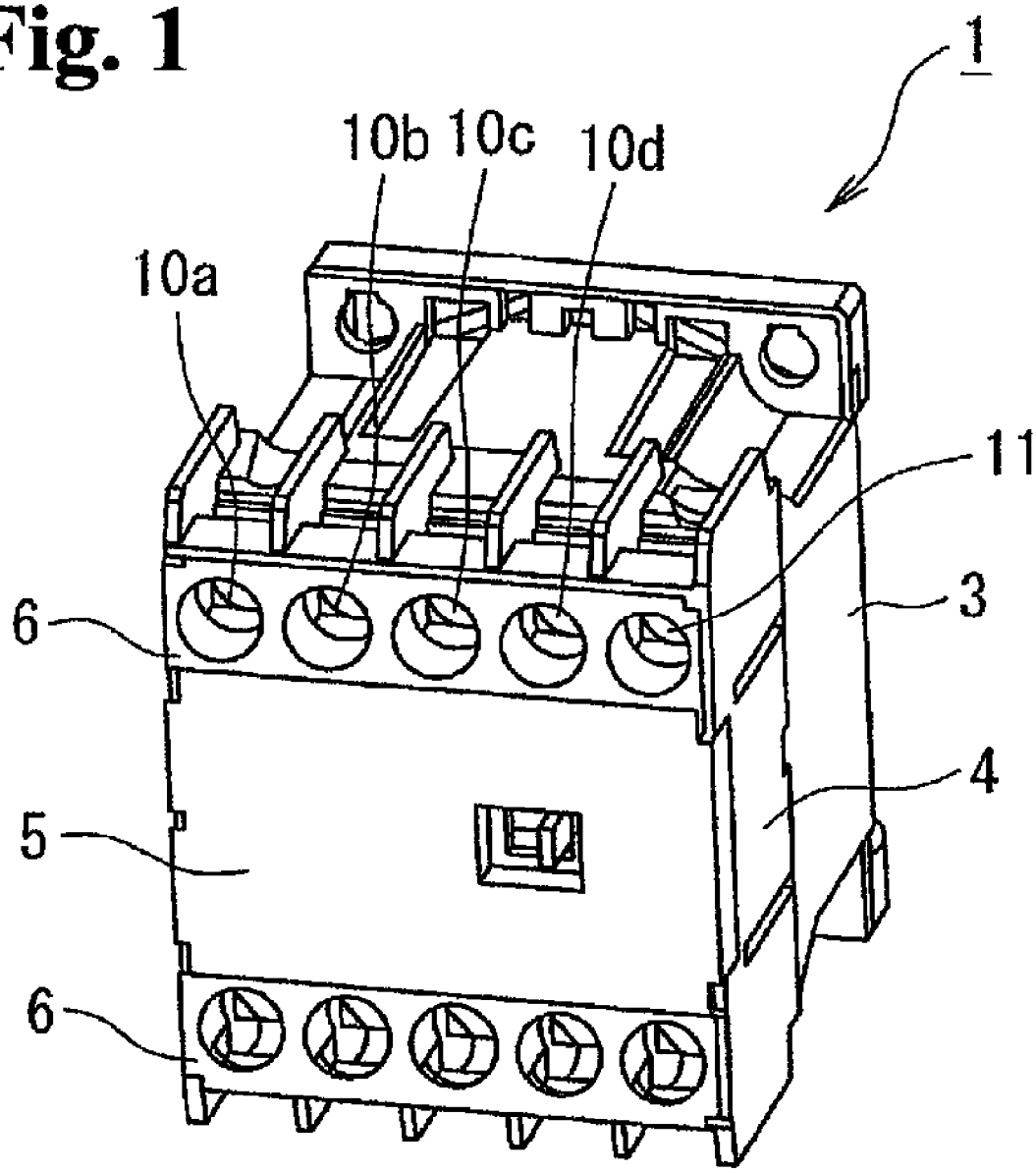
FIG. 1 is a perspective view showing an electromagnetic contactor of an embodiment according to the present invention.

As shown in FIG. 1, an electromagnetic contactor 1 of the present embodiment includes a lowercase 3 and an upper case 4 which are formed of a synthetic resin material having insulation properties.

In the upper case 4, there are disposed terminal portions 10*a* to 10*d* each having a contact and coil terminals 11 of an electromagnet. To the upper case 4, an arc extinguishing cover 5 which accommodates a movable contact support 7*a* in a sealed state is attached.

Figure 2:
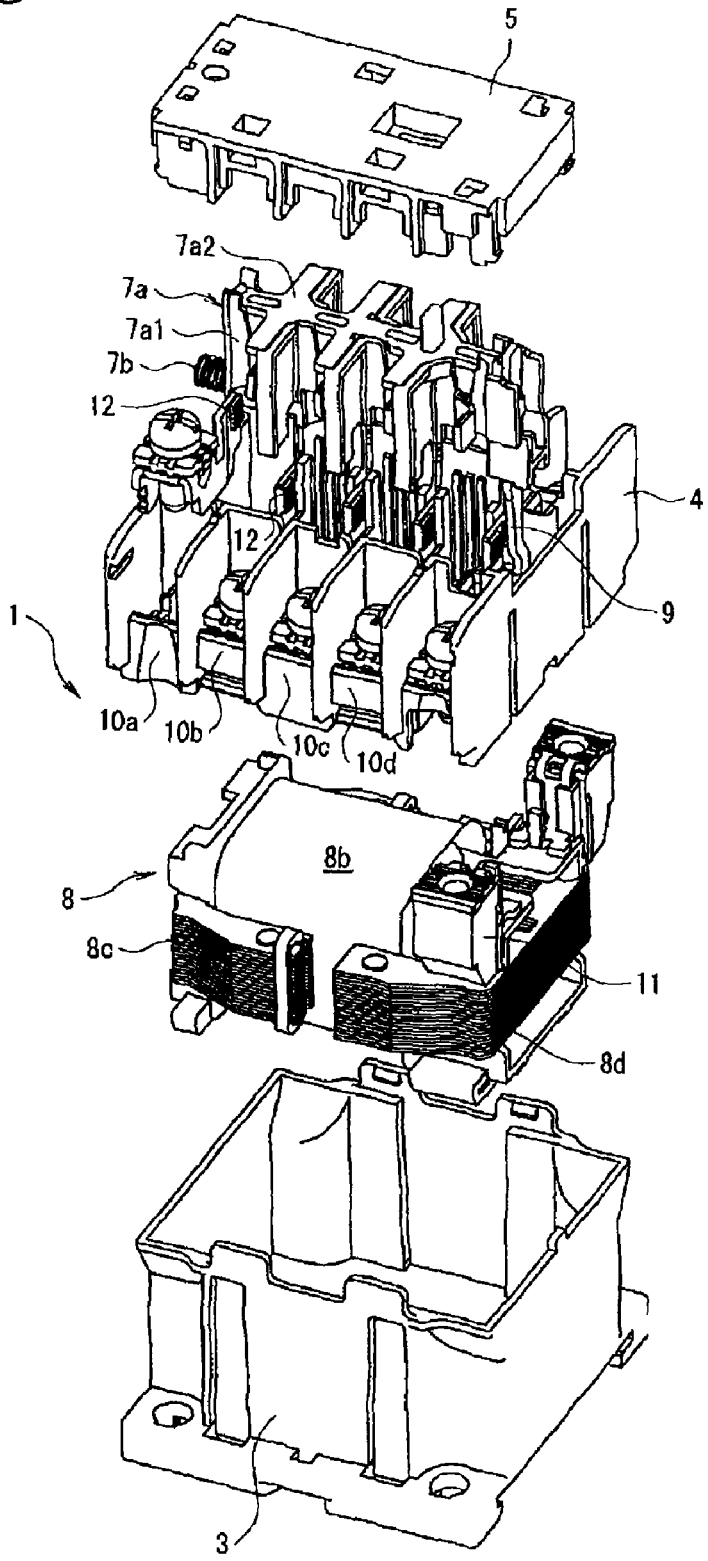
FIG. 2 is an exploded perspective view showing constituent members of the electromagnetic contactor.

As shown in FIG. 2, in the upper case 4, the movable contact support 7*a* and a return spring 7*b* are accommodated.

The movable contact support 7*a* includes a movable contact support base 7*a*1 and a movable contact support cover 7*a*2 which is coupled to the movable contact support base 7*a*1, and in the movable contact support base 7*a*1, a plurality of movable contacts (not shown) is disposed in combination with contact springs (not shown). In addition, the terminal portions 10*a* to 10*d* each having the contact attached to the upper case 4 are provided with contact pieces 12, and fixed contacts (not shown) provided in the contact pieces 12 face the individual movable contacts.

Further, in the lower case 3, an AC-operated electromagnet 8 is accommodated. The electromagnet 8 includes a coil frame 8*b* having an exciting coil 8*a* (see FIG. 3) wound therearound, a fixed core 8*c* which is inserted into a hollow portion of the coil frame 8*b* and fixed to a side wall of the lower case 3, a movable core 8*d* which faces the fixed core 8*c* so as to be movable close to or away from the fixed core 8*c* and is inserted into the hollow portion of the coil frame 8*b*, and a pair of coil terminals 11 which are integrally formed with one end side of the coil frame 8*b* where the movable core 8*d* is disposed in spaced-apart relation. Note that the pair of coil terminals 11 are disposed side by side with the terminal portions 10*a* to 10*d* each having the contact attached in the upper case 4.

Figure 3:
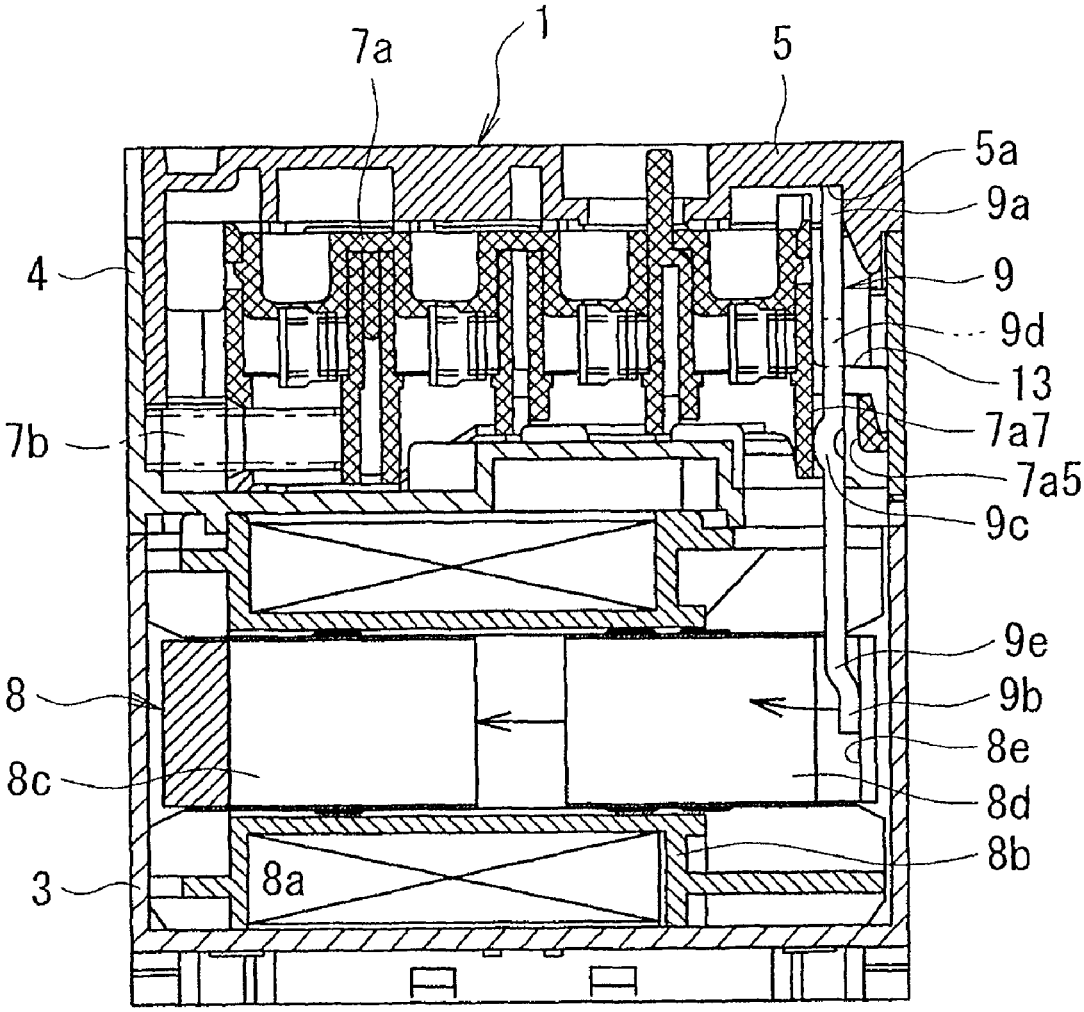
FIG. 3 is a cross-sectional view showing an initial state of the electromagnetic contactor.

As shown in FIG. 3, the movable contact support 7*a* accommodated in the upper case 4 and the electromagnet 8 accommodated in the lower case 3 are disposed such that a movement direction of an opening and closing operation of the movable contact support 7*a* and movement directions (an attraction movement direction and a release movement direction) of the movable core 8*d* are in parallel with each other, and the return spring 7*b* is disposed such that a urging force acts in a direction in which the movable contact support 7*a* is returned to an initial position.

In addition, in order to transmit the attraction movement and the release movement of the movable core 8*d* to the movable contact support 7*a*, as shown in FIG. 3, a drive lever 9 engaged with one end side of the movable contact support 7*a* apart from the return spring 7*b* and the movable core 8*d* is accommodated to extend between the lower case 3 and the upper case 4.

Figure 5:
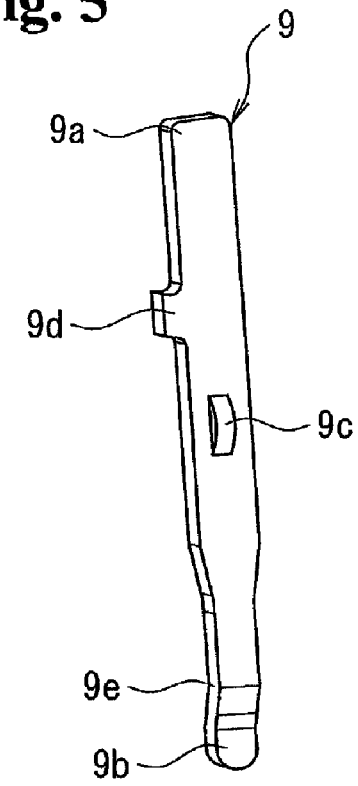
FIG. 5 shows a shape of the drive lever constituting the electromagnetic contactor.

The drive lever 9 is an elongated plate-like member. As shown in FIG. 5, one end thereof in a longitudinal direction serves as a rotation shaft portion 9*a*, a movable core connection portion 9*b* is formed on the other end side thereof in the longitudinal direction, a movable contact support connection portion 9*c* having an expanded shape is provided in a central portion thereof in the longitudinal direction, and one arm portion 9*d* which protrudes outward from one end surface thereof in a plate width direction is formed at a position closer to the rotation shaft portion 9*a* than the movable contact support connection portion 9*c*.

Figure 6:
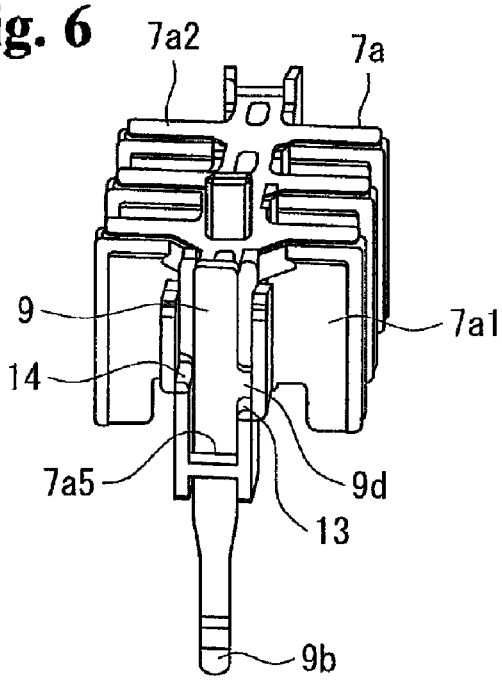
FIG. 6 shows an engagement state between the movable contact support and the drive lever constituting the electromagnetic contactor.

As shown in FIGS. 3 and 6, on one end side of the movable contact support base 7*a*1 constituting the movable contact support 7*a*, there is formed a lever passage hole 7*a*5 through which the drive lever 9 passes from above. As shown on the right side of FIG. 3, the lever passage hole 7*a*5 is provided with a lever engagement wall 7*a*7 which can abut on the movable contact support connection portion 9*c*.

As shown in FIG. 3, the movable core connection portion 9*b* of the drive lever 9 which has passed through the lever passage hole 7*a*5 is inserted into a loose-fitting hole 8*e* formed in the movable core 8*d* from above and engaged therewith. Herein, there is provided a bend portion 9*e* between the movable core connection portion 9*b* and the movable contact support connection portion 9*c*, and the movable core connection portion 9*b* inserted into the loose-fitting hole 8*e* is contacting with an inner surface of the loose-fitting hole 8*e* which is farthest from the fixed core 8*c*.

Figure 7:
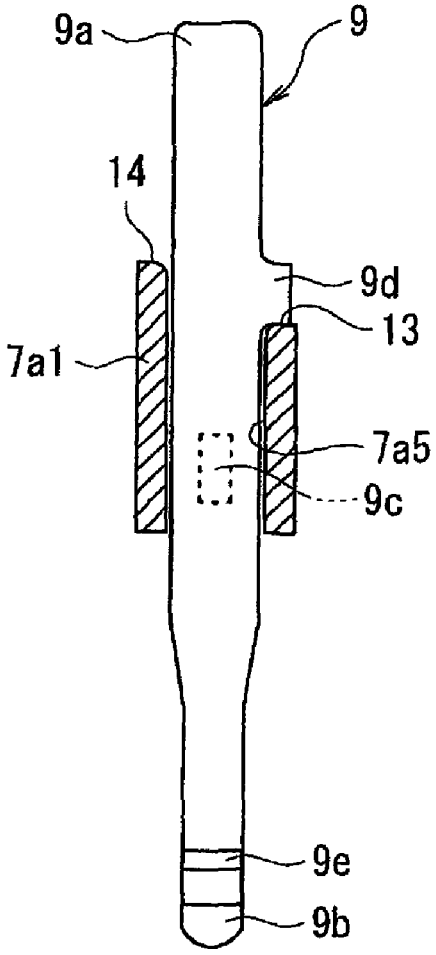
FIGS. 7(*a*), 7 (*b*) are simplified views showing a correct assembly state and an incorrect assembly state of the drive lever.
Figure 7:
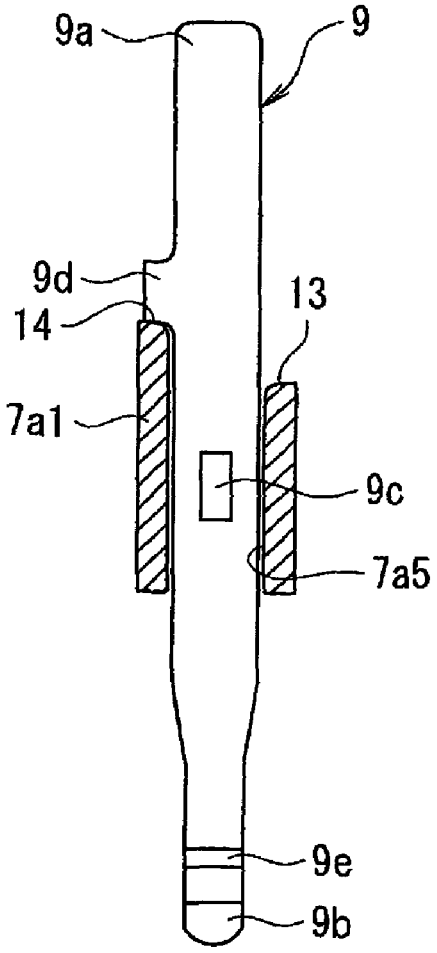

As shown in a correct assembly state of FIG. 7(*a*), the arm portion 9*d* which protrudes outward from one end surface of the drive lever 9 in the plate width direction abutably faces an arm portion receiving surface 13 formed on a peripheral edge of an opening portion which is opened on the arc extinguishing cover 5 side of the lever passage hole 7*a*5.

As shown in FIG. 3, the rotation shaft portion 9*a* of the drive lever 9 enters into a shaft concave portion 5*a* provided in a lower surface of the arc extinguishing cover 5, and is rotatably engaged therewith. When the arc extinguishing cover 5 is attached to the upper case 4, the shaft concave portion 5*a* holds the rotation shaft portion 9*a* of the drive lever 9, and also presses the arm portion 9*d* against the arm portion receiving surface 13.

Thus, the drive lever 9, which has the rotation shaft portion 9*a* rotatably engaged with the shaft concave portion 5*a* of the arc extinguishing cover 5 and the movable core connection portion 9*b* engaged with the loose-fitting hole 8*e* of the movable core 8*d* (the inner surface of the loose-fitting hole 8*e* which is farthest from the fixed core 8*c*) , rotates about the rotation shaft portion 9*a* serving as the rotation shaft with the movement of the movable core 8*d*, and the rotation of the drive lever 9 is transmitted to the movable contact support 7*a* via the movable contact support connection portion 9*c*.

Herein, as shown in FIG. 7(*a*) , on the peripheral edge of the opening portion of the lever passage hole 7*a*5 facing the other end surface of the drive lever 9 in the plate width direction (the end surface positioned opposite to the end surface formed with the arm portion 9*d*) , there is formed an incorrect assembly preventing surface 14 which is closer to the side of the attachment of the arc extinguishing cover 5 than the above-described arm portion receiving surface 13, and on which the arm portion 9*d* can abut.

Note that a case of the present invention corresponds to the lower case 3 and the upper case 4, a cover of the present invention corresponds to the arc extinguishing cover 5, one end portion of a drive lever of the present invention corresponds to the movable core connection portion 9*b*, the other end portion of the drive lever of the present invention corresponds to the rotation shaft portion 9*a*, and a drive lever incorrect assembly detection portion of the present invention corresponds to the arm portion 9*d* and the incorrect assembly preventing surface 14.

Figure 4:
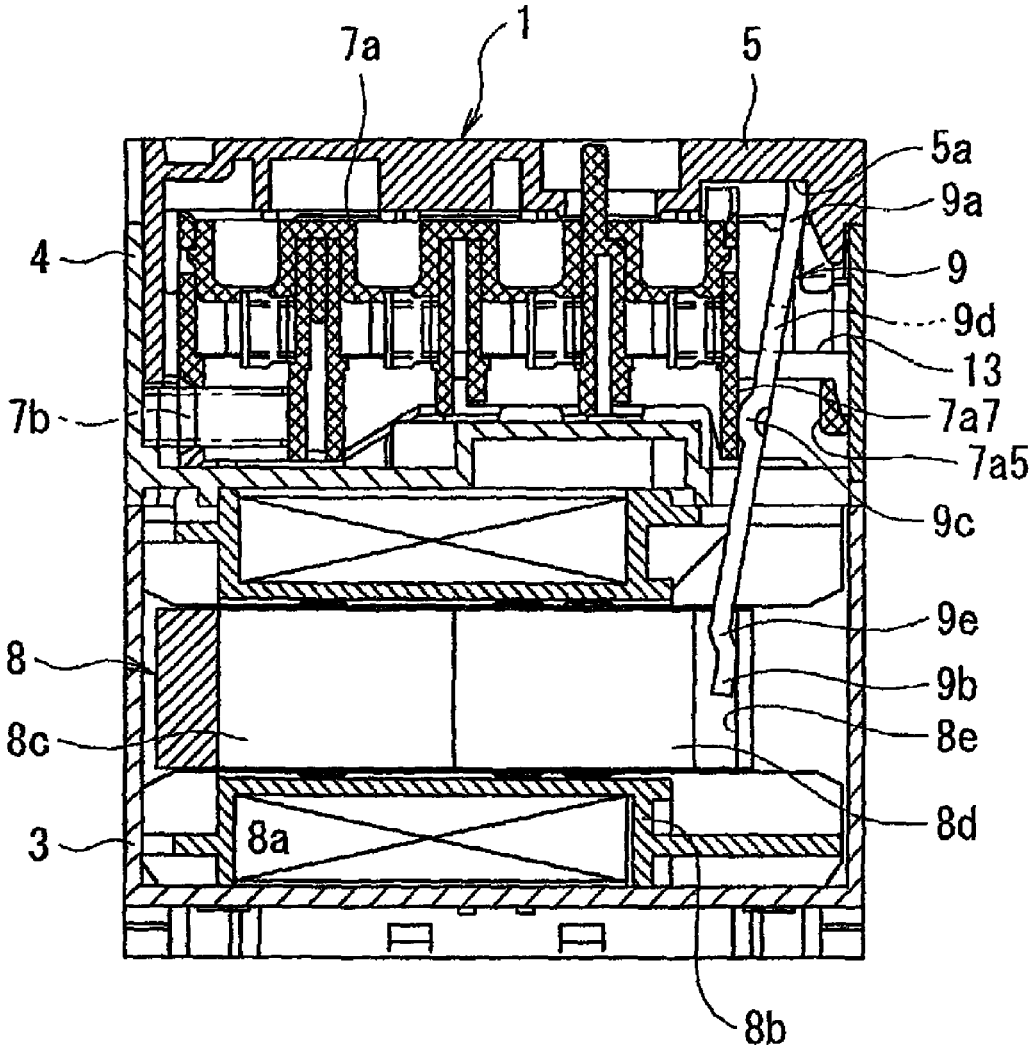
FIG. 4 is a cross-sectional view showing states of rotation of a drive lever and a movement of a movable contact support to an operation position when a movable core of the electromagnetic contactor performs an attraction movement.

Next, a description is given of the operation of the electromagnetic contactor 1 of the present embodiment with reference to FIGS. 3 and 4.

In the electromagnetic contactor 1 of the present embodiment, when the exciting coil 8*a* of the electromagnet 8 is in a non-excited state, as shown in FIG. 3, an attraction force does not act between the fixed core 8*c* and the movable core 8*d*, and the movable contact support 7*a* is positioned on the right in FIG. 3 by the urging force of the return spring 7*b* (hereinafter referred to as an initial position of the movable contact support 7*a*) . At this point, a movable contact 7*a*3 of a contact a of the movable contact support 7*a* is apart from the fixed contact, and the movable contact 7*a*3 of a contact b is in contact with the fixed contact.

Next, when the exciting coil 8*a* of the electromagnet 8 is brought into the excited state, the attraction force acts between the fixed core 8*c* and the movable core 8*d*, and the movable core 8*d* performs the attraction movement toward the fixed core 8*c*. As shown in FIG. 4, when the movable core 8*d* performs the attraction movement toward the left side in the drawing, since the movable core connection portion 9*b* is in contact with the inner surface of the loose-fitting hole 8*e* which is farthest from the fixed core 8*c*, the drive lever 9 rotates clockwise about the rotation shaft portion 9*a* engaged with the shaft concave portion 5*a* serving as the rotation shaft, and the movable contact support 7*a* pressed by the movable contact support connection portion 9*c* moves in an operation direction against the return spring 7*b*. When the movable contact support 7*a* has moved to an operation position, the movable contact 7*a*3 of the contact a of the movable contact support 7*a* contacts the fixed contact, and the movable contact 7*a*3 of the contact b moves away from the fixed contact.

In addition, when the exciting coil 8*a* of the electromagnet 8 is brought into the non-excited state with the movable contact support 7*a* at the operation position, the movable contact support 7*a* on which the urging force of the return spring 7*b* acts gradually moves to the initial position. Further, an external force is transmitted from the movable contact support 7*a* moving by the urging force of the return spring 7*b* via the drive lever 9 and the drive lever 9 rotates counterclockwise, whereby the movable core 8*d* of the electromagnet 8 performs a release movement in a direction in which the movable core 8*d* moves away from the fixed core 8*c*.

Herein, the drive lever 9 of the electromagnetic contactor 1 has directivity at the time of assembly that the assembly is performed such that the movable contact support connection portion 9*c* abuts on the lever engagement wall 7*a*7 of the lever passage hole 7*a*5, and the movable core connection portion 9*b* contacts the inner surface of the loose-fitting hole 8*e* formed in the movable core 8*d* which is farthest from the fixed core 8*c*.

Figure 8:
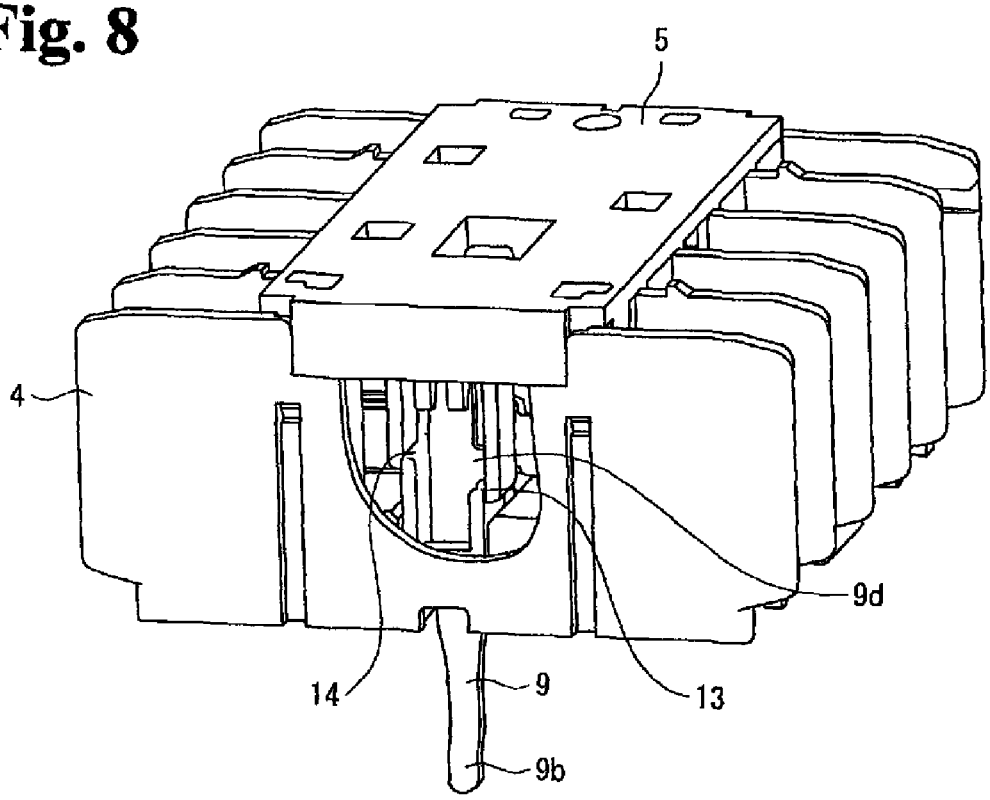
FIG. 8 shows a state where a cover is attached to a case when the drive lever is correctly assembled.
Figure 9:
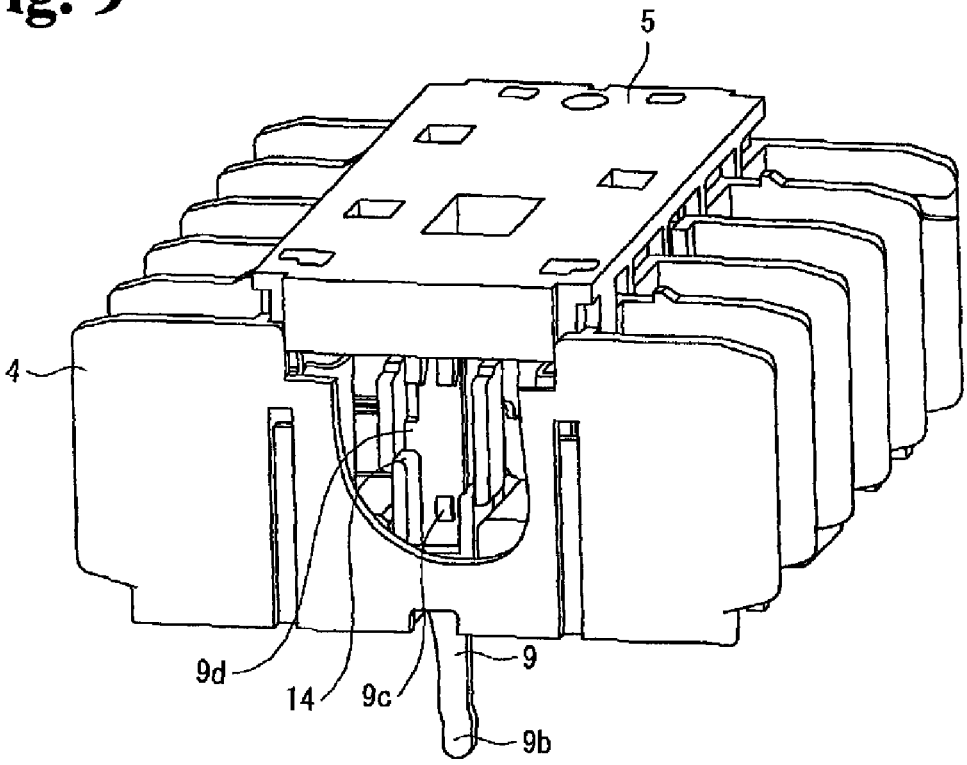
FIG. 9 shows a state where the cover cannot be attached to the case in the incorrect assembly of the drive lever.

A description is given of cases where the drive lever 9 having directivity at the time of assembly is correctly assembled and incorrectly assembled with reference to FIGS. 7 to 9. Note that each of FIGS. 7(*a*) and 8 shows the correct assembly of the drive lever 9, while each of FIGS. 7(*b*) and 9 shows the incorrect assembly of the drive lever 9.

As shown in FIG. 7(*a*), in the drive lever 9 in the correct assembly, the arm portion 9*d* protruding outward from one end surface in the plate width direction abutably faces the arm portion receiving surface 13 formed on the peripheral edge of the opening portion opened on the arc extinguishing cover 5 side of the lever passage hole 7*a*5, and the rotation shaft portion 9*a* at one end thereof is disposed so as not to protrude into the space in the upper case 4 where the arc extinguishing cover 5 is to be attached. Note that the movable contact support connection portion 9*c* of the drive lever 9 abuts on the lever engagement wall 7*a*7 of the lever passage hole 7*a*5, and the movable core connection portion 9*b* contacts the inner surface of the loose-fitting hole 8*e* of the movable core 8*d* which is farthest from the fixed core 8*c*.

Subsequently, as shown in FIG. 8, the arc extinguishing cover 5 is attached to the upper case 4, whereby the assembly of the drive lever 9 is completed in a state where the shaft concave portion 5*a* of the arc extinguishing cover 5 holds the rotation shaft portion 9*a*, and the arm portion 9*d* is pressed against the arm portion receiving surface 13.

On the other hand, it is assumed that the incorrect assembly is performed in a state where the orientation of the drive lever 9 is reversed. That is, when the incorrect assembly of the drive lever 9 is performed in a state where the movable contact support connection portion 9*c* does not abut on the lever engagement wall 7*a*7 of the lever passage hole 7*a*5, and the movable core connection portion 9*b* does not come in contact with the inner surface of the loose-fitting hole 8*e* of the movable core 8*d* which is farthest from the fixed core 8*c*, as shown in FIG. 7(*b*), the arm portion 9*d* of the drive lever 9 abuts on the incorrect assembly preventing surface 14 provided on the peripheral edge of the opening portion of the lever passage hole 7*a*5 which is closer to the side of the attachment of the arc extinguishing cover 5 than the arm portion receiving surface 13.

The arm portion 9*d* of the drive lever 9 abuts on the incorrect assembly preventing surface 14 closer to the side of the attachment of the arc extinguishing cover 5 than the arm portion receiving surface 13, and the rotation shaft portion 9*a* of the drive lever 9 is thereby disposed so as to protrude into the space in the upper case 4 where the arc extinguishing cover 5 is to be attached.

Subsequently, as shown in FIG. 9, when trying to attach the arc extinguishing cover 5 to the upper case 4, since the rotation shaft portion 9*a* of the drive lever 9 protrudes into the space where the arc extinguishing cover 5 is to be attached, it is not possible to attach the arc extinguishing cover 5 to the upper case 4.

Consequently, when the drive lever 9 having directivity at the time of assembly is assembled in the incorrect direction, since it becomes impossible to attach the arc extinguishing cover 5 to the upper case 4, it is possible to easily recognize the incorrect assembly of the drive lever 9.

With this, since it is possible to lessen work for visually ascertaining the orientation of the assembly of the drive lever 9 when the drive lever 9 is assembled, and reduce a time required for the assembly of the electromagnetic contactor 1, it is possible to improve assembly efficiency.

In addition, the structure in which the attachment of the arc extinguishing cover 5 to the upper case 4 is prevented when the incorrect assembly of the drive lever 9 is performed is the structure in which the arm portion 9*d* formed to protrude from one end surface of the drive lever 9 in the plate width direction abuts on the incorrect assembly preventing surface 14 disposed closer to the side of the attachment of the arc extinguishing cover 5 than the arm portion receiving surface 13 on which the arm portion 9*d* abuts at the time of the correct assembly to thereby cause the the rotation shaft portion 9*a* of the drive lever 9 to protrude into the space in the upper cover 4 where the arc extinguishing cover 5 is to be attached, whereby the attachment of the arc extinguishing cover 5 to the upper case 4 is prevented, and, since the attachment of the arc extinguishing cover 5 to the upper case 4 is prevented using the simple structure, it is possible to achieve a reduction in manufacturing cost.

INDUSTRIAL APPLICABILITY

Thus, the electromagnetic contactor and the assembly method for the same according to the present invention are useful for allowing reliable prevention of the incorrect assembly of the drive lever having directivity at the time of assembly.

EXPLANATION OF REFERENCE NUMERALS

1 electromagnetic contactor,
3 lower case,
4 upper case,
5 arc extinguishing cover,
5*a* shaft concave portion,
7*a* movable contact support,
7*a*1 movable contact support base,
7*a*2 movable contact support cover,
7*a*5 lever passage hole,
7*a*7 lever engagement wall,
8 electromagnet,
8*a* exciting coil,
8*b* coil frame,
8*c* fixed core,
8*d* movable core,
8*e* loose-fitting hole,
9 drive lever,
9*a* rotation shaft portion,
9*b* movable core connection portion,
9*c* movable contact support connection portion,
9*d* arm portion,
9*e* bend portion,
10*a* to 10*d* terminal portion,
11 coil terminal,
12 contact piece,
13 arm portion receiving surface,
14 incorrect assembly preventing surface

What is claimed is:

1. An electromagnetic contactor comprising a case accommodating:

an electromagnet having a movable core;

a movable contact support moving in parallel with a moving direction of the movable core; and a drive lever which has directivity in assembly in the case, one end portion engaged with the movable core, and a central portion in a longitudinal direction engaged with the movable contact support, wherein the drive lever made rotatable about the other end portion thereof serving as a rotation axis transmits a movement of the movable core to the movable contact support by engaging the other end portion of the drive lever to an inner wall of a cover attached to the case covering the movable contact support, and a drive lever incorrect assembly detection portion is provided in which in a state where the drive lever is assembled in a correct direction, the driver is accommodated to attach the cover on the case, and in a state in which the drive lever is assembled in an incorrect direction, the other end portion of the drive lever protrudes to a position where the cover is attached to the case to prevent the attachment of the cover to the case.

2. An electromagnetic contactor according to claim 1, wherein the drive lever incorrect assembly detection portion comprises:

an arm portion formed in the central portion of the drive lever, and protruding from one end portion in a direction orthogonal to a rotating direction of the drive lever;

an arm portion receiving surface formed on the movable contact support, and on which the arm portion abuts while accommodating the drive lever to attach the cover to the case in the state in which the drive lever is assembled in the correct direction; and an incorrect assembly preventing surface formed on the movable contact support to be closer to a position where the cover is attached than the arm portion receiving surface, and on which the arm portion abuts to protrude the other end portion of the drive lever to the position where the cover is to be attached to the case in the state in which the drive lever is assembled in the incorrect direction.

3. An assembly method for an electromagnetic contactor according to claim 1, comprising the steps of:

judging, after accommodating the electromagnet, the movable contact support, and the drive lever in the case, whether attaching the cover to the case is possible, or whether the attaching the cover to the case is not possible by protruding the other end portion of the drive lever toward the position where the cover is to be attached to the case; and determining presence of the incorrect assembly of the drive lever.

* * * * *